US008231107B2

(12) United States Patent
Spracklen

(10) Patent No.: US 8,231,107 B2
(45) Date of Patent: Jul. 31, 2012

(54) HAND TOOL

(76) Inventor: Melvin Spracklen, Wall, NJ (US)

( * ) Notice: Subject to any disclaimer, the term of this patent is extended or adjusted under 35 U.S.C. 154(b) by 324 days.

(21) Appl. No.: 12/509,539

(22) Filed: Jul. 27, 2009

(65) Prior Publication Data

US 2010/0108962 A1 May 6, 2010

Related U.S. Application Data

(60) Provisional application No. 61/111,519, filed on Nov. 5, 2008.

(51) Int. Cl.
*B66F 15/00* (2006.01)

(52) U.S. Cl. ..... 254/131.5; 254/25; 254/131; 269/3; 269/6

(58) Field of Classification Search ..... 254/131.5, 254/131, 120, 21, 25, 28; 269/3, 6
See application file for complete search history.

(56) References Cited

U.S. PATENT DOCUMENTS 2,457,231 A 8/1946 Hendersom
4,477,972 A * 10/1984 Testa, Jr. ..... 30/172
5,820,107 A * 10/1998 Hall ..... 254/25
6,488,266 B2 12/2002 Macor
6,752,380 B1 6/2004 Taylor
6,918,321 B1 * 7/2005 Whittaker ..... 81/45
6,994,322 B1 * 2/2006 Wittman ..... 254/131
7,634,845 B1 * 12/2009 Sim ..... 29/267
7,950,627 B2 * 5/2011 Foley ..... 254/21
2010/0108962 A1 * 5/2010 Spracklen ..... 254/131.5
* cited by examiner

*Primary Examiner* — Lee D Wilson
(74) *Attorney, Agent, or Firm* — Aidenbaum Schloff and Bloom PLLC; Jay Schloff

(57) ABSTRACT

A hand tool for lifting and separating objects. The hand tool includes a body member and a handle member. The body member includes a shaft member having a linear configuration, a neck member, and an elongated member. The shaft member includes a first end portion and a second end portion. The first end portion of the shaft member is tapered into a planar surface. The neck member extends obtusely from the second end portion of the shaft member. The neck member includes a proximal end portion and a distal end portion such that the proximal end portion of the neck member merges with the second end portion of the shaft member. The elongated member extends from the distal end portion of the neck member, such that, the elongated member is substantially parallel to the shaft member. The handle member is configured on the elongated member.

6 Claims, 3 Drawing Sheets

HAND TOOL

CROSS-REFERENCE TO RELATED APPLICATIONS

The present disclosure claims priority under 35 United States Code, Section 119 on the U.S. Provisional Patent Application No. 61/111,519 filed on Nov. 5, 2008 the disclosure of which is incorporated by reference.

FIELD OF THE DISCLOSURE

The present disclosure generally relates to hand tools, and, more particularly, to a hand tool for assisting lifting of objects, such as wooden boxes, and separating multiple items, such as packs of shingles and the like.

BACKGROUND OF THE DISCLOSURE

Generally, while lifting objects, a user may use his/her fingers to grip edges of the objects. If held improperly, the user may lose grip on the object, which may trap his or her fingers under the weight of the object. This may cause injury to the fingers of the user. Moreover, some objects may be fairly heavy for a person to lift by hand. As such, the person trying to lift the heavy load may get physically injured. Examples of common physical injuries caused while lifting loads includes back sprains, muscle pulls, spinal injuries, and the like.

In some cases, objects may not have handles attached to them. Lifting of such handleless objects makes the process of lifting even more difficult, thereby increasing the risk of injuries. Moreover, the handleless objects are associated with a risk of being dropped while lifting, if not held properly. Typically, bulky equipment such as a fork lift and the like are used for lifting such handleless objects. However, operating such bulky equipment may be inconvenient and time consuming for the user. Moreover, before using the fork lift for lifting the object, the object must be lifted slightly. This slight lifting of the object may be inconvenient for the user.

Currently, various other hand tools are also utilized to accomplish the tasks of lifting objects such as boxes, and separating multiple objects such as pack of shingles. Typically, in settings such as automotive garages, warehouses, and the like, a variety of tasks associated with lifting and separation of objects are required to be done, and accordingly users carry multiple tools for accomplishing such tasks. For instance, in order to lift heavy objects and to separate multiple objects, a user may carry a lifting tool such as a crow bar, and a separating tool. However, the crow bar may be unable to provide enough support to lift objects of significant weight with force applied by the user. Since, the crow bar may be unsuitable for separating multiple objects the user may carry an additional tool (apart from the crow bar) for separating the multiple objects. However, carrying different tools for separate tasks such as lifting objects and separating multiple objects may inconvenience the user.

Mostly, the hand tools mentioned above consist of an elongated rod. Ends of the elongated rod may be configured in various shapes for performing different functions such as pulling out nails, and the like. In use, the user holds a hand tool at any portion along the elongated rod. Such handling of the hand tool may be dangerous for the user, as it may cause injuries to the hands of the user. Moreover, the user may be unable to acquire a firm grip of the hand tool for usage thereof. Further, the hand tools, for various tasks as mentioned herein above, are generally metal tools. The metal tools provide sufficient strength and rigidity and assist the user while performing any task. However, the metal tools may become rusted if exposed to moisture for an extended period of time.

Accordingly, there exists a need for a hand tool which is capable of lifting and separating heavy objects. Further, there exists a need for a hand tool for lifting and separating heavy objects such that the hand tool minimizes the risk of injuries to users while usage thereof. Furthermore, there exists a need for a hand tool for lifting and separating heavy objects such that the hand tool provides a grip for being firmly and conveniently held by a user. Moreover, there exists a need for avoiding rusting of a hand tool capable of lifting and separating heavy objects. In addition, there exists a need for a hand tool for lifting and separating heavy objects that is portable and is convenient to use.

SUMMARY OF THE DISCLOSURE

In view of the foregoing disadvantages inherent in the prior art, the general purpose of the present disclosure is to provide a hand tool for lifting and separating objects such as wooden boxes, packs of shingles, and the like, configured to include all the advantages of the prior art, and to overcome the drawbacks inherent therein.

Therefore, an object of the present disclosure is to provide a hand tool that is capable of lifting and separating heavy objects.

Another object of the present disclosure is to provide a hand tool for lifting and separating heavy objects such that the hand tool minimizes the risk of injuries to users while usage thereof.

Yet another object of the present disclosure is to provide a hand tool for lifting and separating heavy objects such that the hand tool provides a grip for being firmly and conveniently held by a user.

Still another object of the present disclosure is to avoid rusting of a hand tool capable of lifting and separating heavy objects.

Yet another object of the present disclosure is to provide a hand tool for lifting and separating heavy objects that is portable and convenient to use.

To achieve the above objects, in an aspect of the present disclosure, a hand tool is provided that is capable of lifting and separating objects. The hand tool includes a body member and a handle member. Further, the body member includes a shaft member having a linear configuration, a neck member, and an elongated member. The shaft member includes a first end portion and a second end portion. The first end portion of the shaft member is tapered into a planar surface. The neck member extends obtusely from the second end portion of the shaft member. The neck member includes a proximal end portion and a distal end portion, such that the proximal end portion of the neck member merges with the second end portion of the shaft member. Moreover, the elongated member extends from the distal end portion of the neck member, such that the elongated member is substantially parallel to the shaft member. The handle member is configured on the elongated member. The handle member provides a grip for holding the hand tool.

In another aspect of the present disclosure, the hand tool includes a loop member configured at an end portion of the handle member for securing the hand tool around a wrist portion of a user, thereby enabling a convenient usage of the hand tool.

The hand tool as disclosed herein is capable of lifting and separating objects, specifically the hand tool assists in lifting heavy objects such as wooden boxes, and separating multiple objects such as packs of shingles. The handle member minimizes the risk of injuries to a user's hands. Moreover, the handle member provides a grip to the user for holding the hand tool. The body member of the hand tool is coated with a chrome finish layer to protect the hand tool against rusting.

These together with other aspects of the present disclosure, along with the various features of novelty that characterize the present disclosure, is pointed out with particularity in the claims annexed hereto and form a part of this present disclosure. For a better understanding of the present disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in structure and design. It should be emphasized, however, that the present disclosure is not limited to a particular hand tool, as shown and described. It is understood that various omissions and substitutions of equivalents are contemplated as circumstances may suggest or render expedient, but these are intended to cover the application or implementation without departing from the spirit or scope of the claims of the present disclosure.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure relates to a hand tool for lifting and separating objects, specifically the hand tool assists in lifting heavy objects such as wooden boxes, and separating multiple objects such as packs of shingles. The hand tool provides a grip for holding the hand tool. The hand tool may also facilitate in minimizing the risk of injuries to a user's hands while lifting the heavy objects or separating multiple objects. Further, the hand tool may be easily stored when not in use. Moreover, the hand tool may be secured around a wrist portion of the user.

Figure 1:
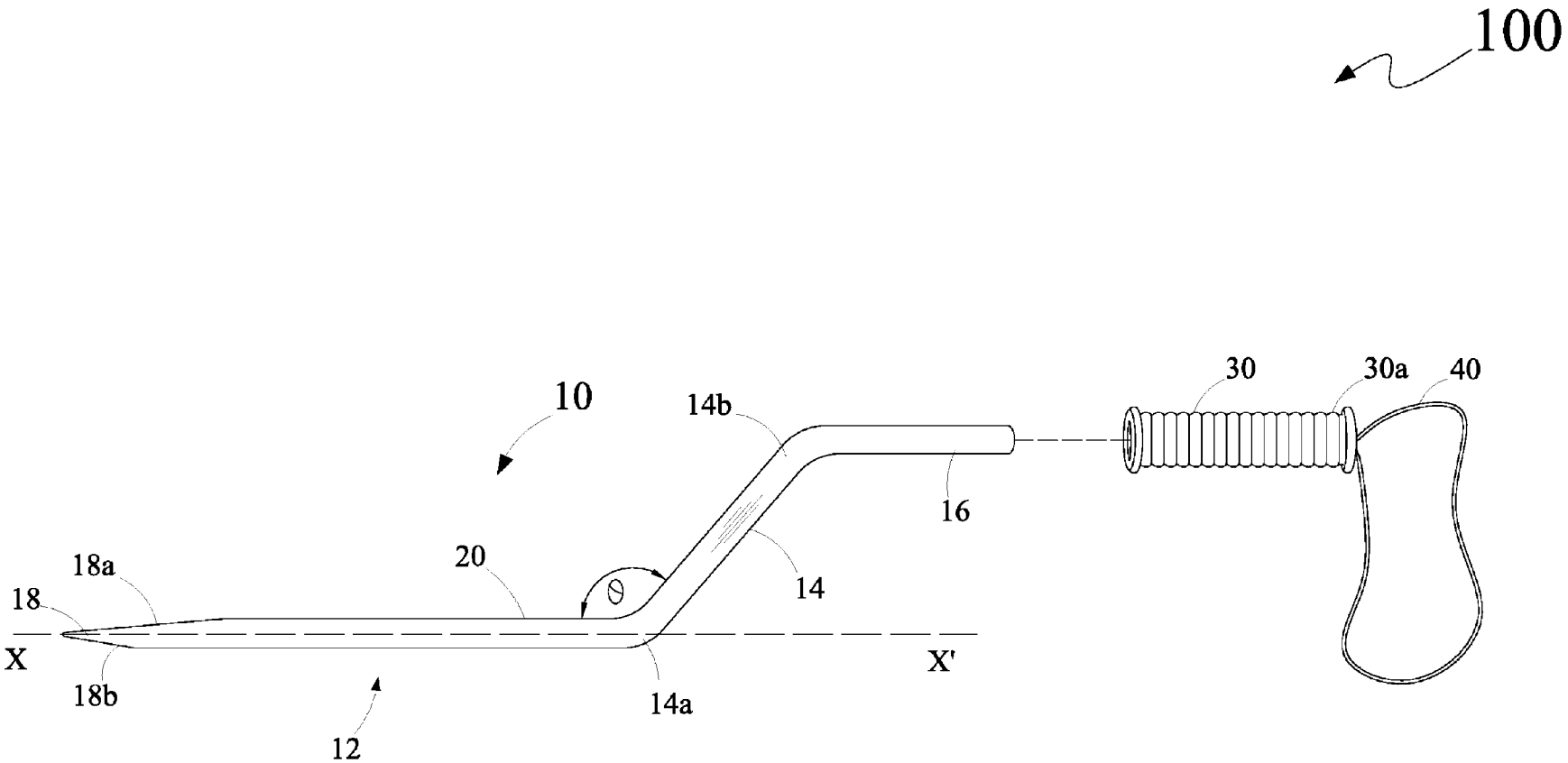
FIG. 1 illustrates an exploded view of a hand tool, in accordance with an embodiment of the present disclosure.
Figure 2:
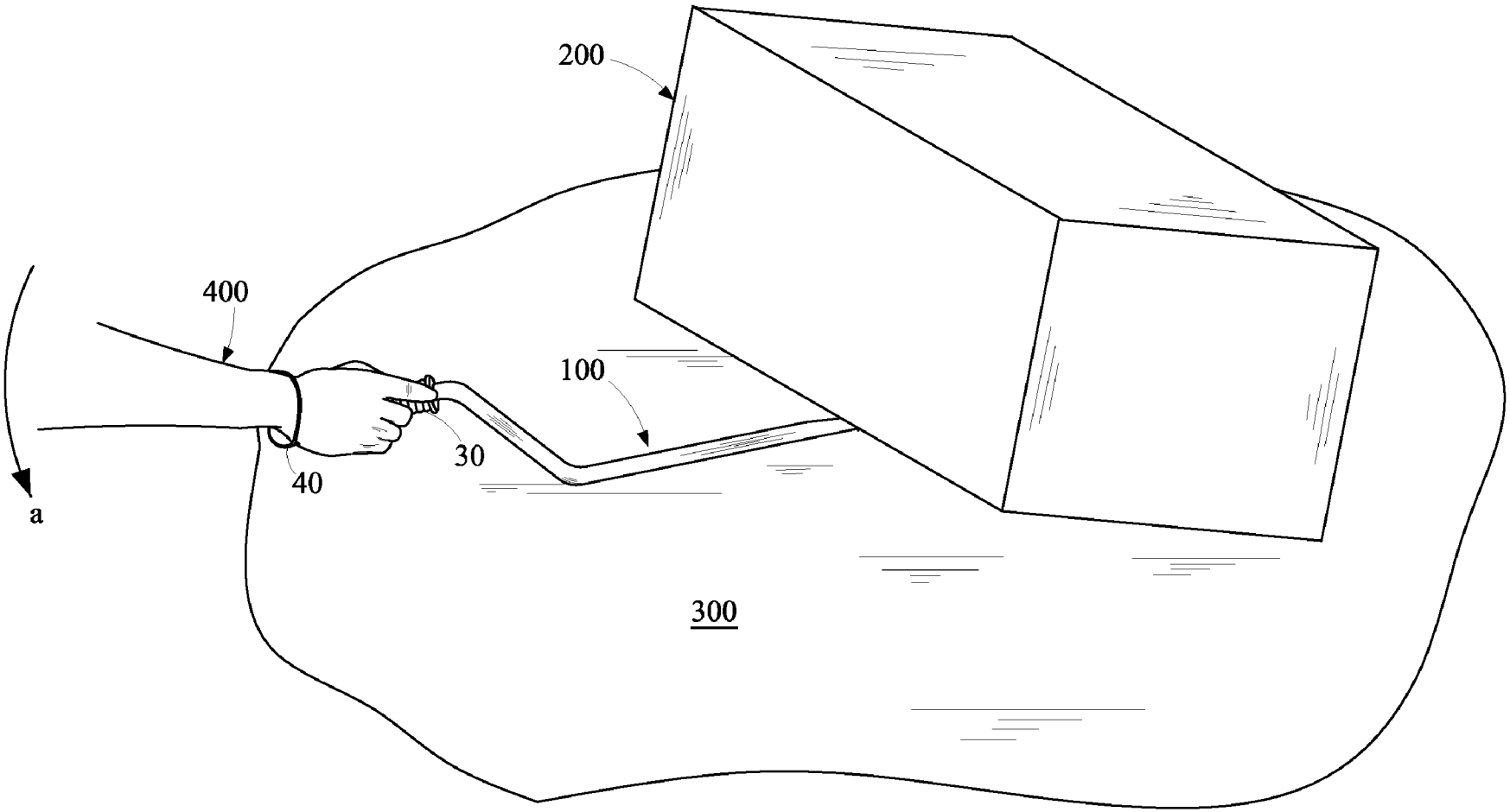
FIG. 2 illustrates a perspective view of the hand tool of FIG. 1 being used to lift a portion of an object, in accordance with an embodiment of the present disclosure.
Figure 3:
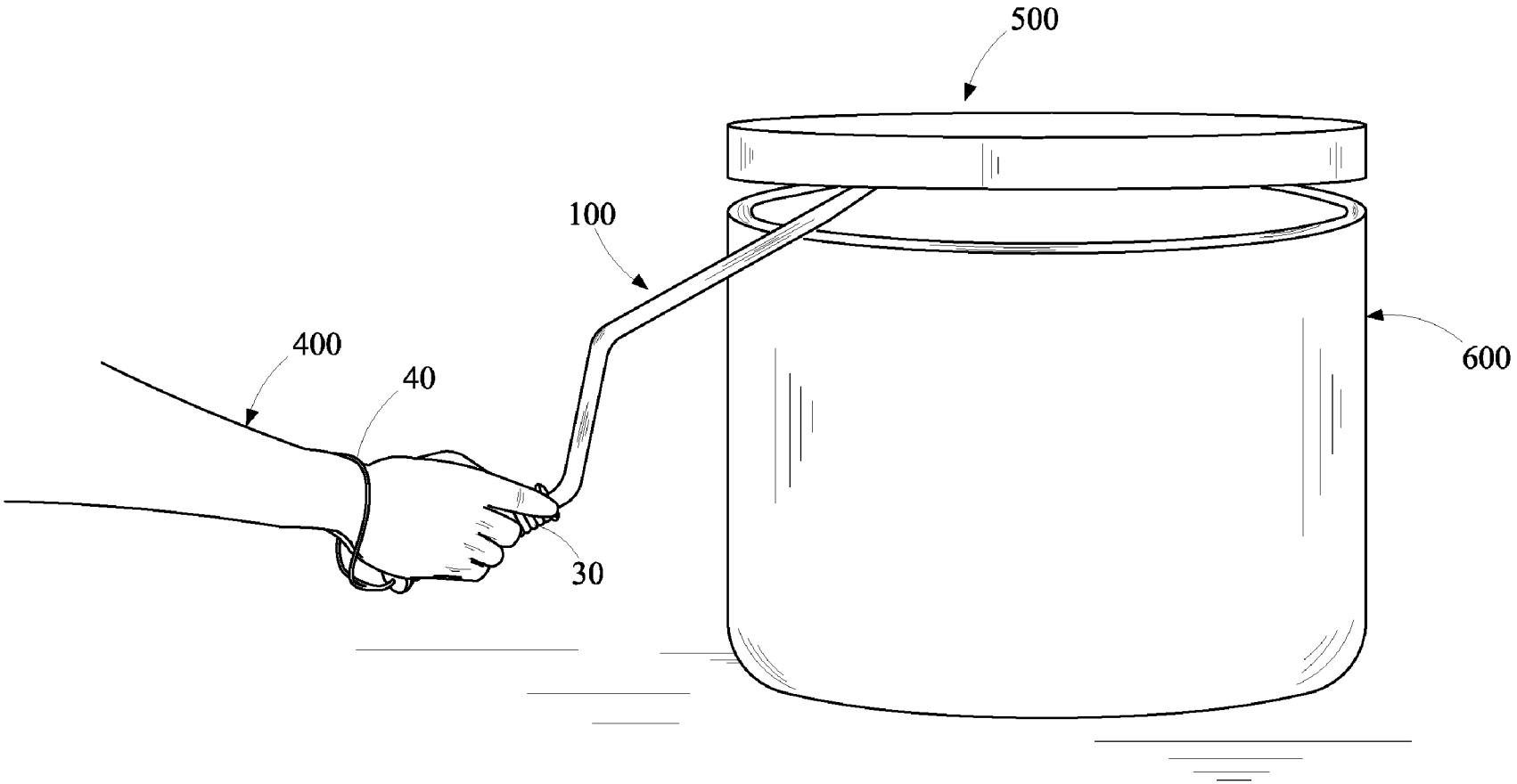
FIG. 3 illustrates a perspective view of the hand tool of FIG. 1 being used to separate two objects, in accordance with another embodiment of the present disclosure.

Referring to FIGS. 1, 2 and 3, a hand tool 100 is illustrated, in accordance with various embodiments of the present disclosure. The hand tool 100 is capable of lifting and separating objects, specifically the hand tool 100 assists in lifting heavy objects such as wooden boxes, and separating multiple objects such as packs of shingles. More particularly, FIG. 1 illustrates an exploded view of the hand tool 100. FIG. 2 illustrates a perspective view of the hand tool 100 of FIG. 1 being used to lift a portion of an object, in accordance with an embodiment of the present disclosure. Further, FIG. 3 illustrates a perspective view of the hand tool 100 of FIG. 1 being used to separate two objects, in accordance with another embodiment of the present disclosure.

Now referring to FIG. 1, the hand tool 100 includes a body member 10, a handle member 30, and a loop member 40 configured at an end portion of the handle member 30. The body member 10 includes a shaft member 12, a neck member 14, and an elongated member 16. The shaft member 12 is adapted to assume a substantially linear configuration about an imaginary horizontal axis (shown as dotted line X-X' in FIG. 1). The shaft member 12 includes a first end portion 18 and a second end portion 20. The first end portion 18 of the shaft member 12 is configured into a tapered planar surface. The tapered planar surface of the first end portion 18 of the shaft member 12 includes an upper surface 18*a* and a lower surface 18*b*.

The neck member 14 extends obtusely from the second end portion 20 of the shaft member 12, such that, the neck member 14 forms an obtuse angle (marked as θ in FIG. 1) with the imaginary horizontal axis X-X' of the shaft member 12. More particularly, the neck member 14 includes a proximal end portion 14*a* and a distal end portion 14*b* such that the proximal end portion 14*a* of the neck member 14 is merged with the second end portion 20 of the shaft member 12, thereby forming a bent portion (not numbered) of angular spread θ. Preferably, the obtuse angle θ formed by the neck member 14 with the imaginary horizontal axis X-X' is approximately about 135 degrees. However, it will be evident to a person skilled in the art that the neck member 14 may form any obtuse angle along the imaginary horizontal axis X-X' of the shaft member 12 based on the requirements.

The elongated member 16 of the body member 10 extends from the distal end portion 14*b* of the neck member 14. The elongated member 16 may be substantially parallel to the shaft member 12.

Preferably, the body member 10 of the hand tool 100 is made of metal for providing strength and rigidity while being used for various tasks. Examples of metal include, but are not limited to iron, bronze, and steel. In an embodiment of the present disclosure, the body member 10 of the hand tool 100 may be coated with a chrome finish layer (not shown) for imparting shine to the hand tool 100. Moreover, the chrome finish prevents the hand tool 100 from getting rusted due to various conditions such as exposure to moisture for an extended period of time.

The handle member 30 of the hand tool 100 may be configured substantially on the elongated member 16 of the body member 10. The handle member 30 may be adapted to assume a hollow tubular configuration. The hollow tubular configuration of the handle member 30 receives a substantial portion of the elongated member 16 of the body member 10. In use, a user may grasp the handle member 30 with his/her hands. The handle member 30 provides a comfortable and firm grip on the hand tool 100, to the user. In an embodiment of the present disclosure, the handle member 30 is made of plastic. Examples of plastic include but are not limited to, polypropylene plastic, polystyrene plastic, and polyacrylics plastic. In another embodiment of the present disclosure, the handle member 30 is made of foam rubber. However, it will be evident to a person skilled in the art that the handle member 30 may be made of other material suitable for gripping, such as wood. Further, the handle member 30 may be configured with an aperture (not shown) at a free end portion 30*a* thereof. The aperture may receive a loop member, such as a loop member 40. The loop member 40 may facilitate hanging of the hand tool 100 when not in use. Accordingly, the loop member 40 provides an ease of storing the hand tool 100. Moreover, the loop member 40 may be secured around a wrist portion 400 of the user (as shown in FIGS. 2 and 3) in a convenient manner while using the hand tool 100.

Referring now to FIG. 2, a perspective view of the hand tool 100 being used to lift a portion of an object 200 is illustrated, in accordance with an embodiment of the present disclosure. Specifically, the hand tool 100 assists a user in lifting heavy objects such as a wooden box, heavy machinery, and the like, with relatively much reduced effort. As described herein above, the tapered planar surface such as the upper surface 18*a* and the lower surface 18*b* (as shown in FIG. 1) of the first end portion 18 of the shaft member 12 provides accessibility in difficult areas, such as between the object 200 and a surface 300. The bent portion between the shaft member 12 and the neck member 14 allows a large upward force to be applied to the hand tool 100 by applying only a minimum amount of downward force at the handle member 30. The bent portion thereby facilitates in lifting a portion of the heavy object, such as the object 200. Further, a user may suspend the loop member 40 along the wrist portion 400 thereof, for conveniently using the hand tool 100.

In operation, the tapered planar surface of the first end portion 18 of the shaft member 12 may be slid under the object 200, to be lifted. The first end portion 18 of the shaft member 12 may be placed under the object 200, in such a way that the upper surface 18*a* of the first end portion 18 of the shaft member 12 may contact a base portion (not shown) of the object 200 to be lifted. The user may hold the handle member 30 for firmly gripping the hand tool 100. The user thereafter may exert a downward force on the handle member 30, to lift the object 200. The downward force refers to a force applied in a direction towards the ground. More specifically, the downward force is shown along the direction of an arrow 'a'. The downward force applied by the user enables a portion of the object 200 to get slightly lifted from a surface, such as the surface 300. Further, the slight lift of the portion of the object 200 allows equipment such as a forklift to be placed under a base portion of the object 200 for completely lifting the object 200. The hand tool 100 enables the user to apply minimum force to lift off the object 200 from the surface 300. Moreover, the handle member 30 of the hand tool 100 facilitates in minimizing the risk of injuries to the hands of the users and also provides a firm grip on the hand tool 100. In another embodiment of the present disclosure, the hand tool 100 may also be used for separating multiple items, which is explained in conjunction with FIG. 3.

Referring to FIG. 3, a perspective view of the hand tool 100 being used to separate two objects is illustrated, in accordance with another embodiment of the present disclosure. The hand tool 100 may be used to separate a first object such as a first object 500 from a second object such as a second object 600. The tapered planar surface such as the upper surface 18*a* and the lower surface 18*b* (as shown in FIG. 1) of the first end portion 18 of the shaft member 12 may be used to separate the first object 500 from the second object 600. In use, a user may grip the handle member 30 for holding the hand tool 100 firmly. The user may wear the loop member 40 in a wrist portion such as the wrist portion 400 thereof. However, it will be evident to a person skilled in the art that the loop member 40 may be secured around the wrist portion 400 of the user as per the user's convenience. The loop member 40 facilitates in securely holding the hand tool 100 by the user. Further, the first end portion 18 of the shaft member 12 is placed between the first object 500 and the second object 600, in such a manner that the lower surface 18*b* (as shown in FIG. 1) of the first end portion 18 of the shaft member 12 of the hand tool 100 comes in contact with a base portion (not shown) of the first object 500.

Thereafter, the user may exert a force on the handle member 30 of the hand tool 100, such that the force facilitates the movement of the first object 500 away from the second object 600. Specifically, the bent portion between the shaft member 12 and the neck member 14 allows a large force to be applied to the hand tool 100 by applying only a minimum amount of force at the handle member 30. With the movement of the handle member 30, the lower surface 18*b* (as shown in FIG. 1) of the first end portion 18 of the shaft member 12 raises a portion of the first object 500 away from the second object 600, thereby separating the first object 500 and the second object 600.

The hand tool 100 may be used while performing a plurality of tasks in automotive workshops, warehouses and the like. The disclosed hand tool such as the hand tool 100 may be fabricated in a variety of sizes or lengths depending on an application area for usage thereof. Preferably, the hand tool may be available in a form of a small tool of about sixteen inches in size, and a larger tool of about twenty inches in size for applications such as lifting or separating heavy objects. However, it will be evident to a person skilled in the art that any size of the hand tool may be produced as per user preferences and application area of the hand tool. Further, the exact dimensions and materials required during the construction and operation of the hand tool may vary while manufacturing the same.

As disclosed herein, the present disclosure provides a hand tool that is capable of lifting and separating objects, specifically the hand tool assists in lifting heavy objects such as wooden boxes, and separating multiple objects such as packs of shingles. Various embodiments of the present disclosure offer following advantages. The hand tool, such as the hand tool 100, as described herein, is capable of lifting objects in automotive workshops, warehouses, and the like. Specifically, the first end portion of the shaft member may be slid under objects, to be lifted from a surface or for separating multiple items. The handle member provides a grip for holding the hand tool. Additionally, the present disclosure provides a loop member capable of being secured around a wrist of a user and for providing ease in handling the hand tool while lifting or separating heavy objects.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present disclosure.

What is claimed is:

1. A hand tool for lifting and separating objects, the hand tool comprising:

a body member, the body member comprising, a shaft member having a substantially linear configuration, the shaft member having a first end portion and a second end portion, the first end portion being tapered into an uninterrupted planar structure, a neck member obtusely extending from the second end portion of the shaft member, the neck member having a proximal end portion and a distal end portion, the proximal end portion of the next member merging with the second end portion of the shaft member, and an elongated member extending from the distal end portion of the neck member, the elongated member being substantially parallel to the shaft member; and a handle member configured on the elongated member, the handle member capable of providing a grip for holding the hand tool.

2. The hand tool of claim 1, wherein the body member is made of metal.

3. The hand tool of claim 1, wherein the handle member is made of plastic.

4. The hand tool of claim 1, wherein the handle member is made of foam rubber.

5. The hand tool of claim 1 further comprising a loop member configured at a free end portion of the handle member, the loop member is capable of being secured around a wrist of a user.

6. The hand tool of claim 1, wherein the body member of the hand tool is coated with a chrome finish layer.

* * * * *